US005947756A

United States Patent [19]

Kodama

[11] Patent Number: 5,947,756

[45] Date of Patent: Sep. 7, 1999

[54] AUTOMATIC CONNECTOR MUTUALLY-FITTING MECHANISM

[75] Inventor: Shinji Kodama, Shizuoka, Japan

[73] Assignee: Yazaki Corporation, Tokyo, Japan

[21] Appl. No.: 08/917,912

[22] Filed: Aug. 27, 1997

[30] Foreign Application Priority Data

Aug. 27, 1996 [JP] Japan ..... 8-225438

[51] Int. Cl.[6] ..... H01R 13/62

[52] U.S. Cl. ..... 439/157

[58] Field of Search ..... 439/157, 152–156, 439/158–160, 310, 372, 34

[56] References Cited

U.S. PATENT DOCUMENTS 5,839,912 11/1998 Schekalla et al. ..... 439/157

FOREIGN PATENT DOCUMENTS 6-243928 9/1994 Japan .

*Primary Examiner*—Paula Bradley
*Assistant Examiner*—Tho D. Ta
*Attorney, Agent, or Firm*—Morgan, Lewis & Bockius LLP

[57] ABSTRACT

An automatic connector mutually-fitting mechanism in which a pair of connectors (used mainly in electric wiring in an automobile), mounted respectively on separate structural members, are fitted together. In the automatic connector mutually-fitting mechanism, one connector is projectably and retractably mounted on one structural member, and the other connector is fixedly mounted on the other structural member, and a fitting lever, having a first cam groove and a second cam groove, is movably mounted on the other structural member while a drive projection, formed on the one structural member, is engaged in the first cam groove, and a driven pin is engaged in the second cam groove, and the two structural members are connected together, and are disengaged from each other, so that the two connectors are fitted together, and are disengaged from each other through the movement of the fitting lever.

3 Claims, 7 Drawing Sheets

AUTOMATIC CONNECTOR MUTUALLY-FITTING MECHANISM

BACKGROUND OF THE INVENTION

1. Field of the Invention

This invention relates to an automatic connector mutually-fitting mechanism in which a pair of connectors (used mainly in electric wiring in an automobile), mounted respectively on separate structural members, are fitted together.

2. Description of the Related Art

One example of connectors for connecting a wire harness, used in electric wiring in an automobile, includes a lever connecting-type connector (disclosed in Japanese Patent Unexamined Publication No. Hei. 6-243928) shown in FIG. 7, in which a pair of connectors a and b are fitted together and disengaged from each other by pivotally moving a lever c. In such a lever connecting-type connector, the connectors a and b are fitted together by pivotally moving the lever c, and therefore there are advantages that the fitting force is reduced and that the positioning for fitting purposes is easy.

However, as shown in FIG. 8, when the lever connecting-type connectors a and b are used so as to connect a wire harness e in an instrument panel d of the automobile to electric wiring in a gauge board f to be mounted on the instrument panel d, the connector b, connected to an end of the wire harness e, is drawn from the instrument panel d, and then is fitted into the connector a mounted on the gauge board f, and then the gauge board f is mounted on the instrument panel d.

Therefore, the wire harness e must have an excess length so that the wire harness can be pulled to be extended exteriorly of the instrument panel d so as to effect the connecting operation, which results in a disadvantage that the cost of the member, as well as the weight, is inevitably increased. Besides, when mounting the gauge board f on the instrument panel d, there is a possibility that the wire harness e is caught or bitten between the instrument panel d and the gauge board f, and in such a case this mounting operation can not be carried out, and also the wire harness e may be damaged.

On the other hand, in order to simplify the fitting operation, there has been proposed a method as shown in FIG. 9, in which a receiving connector h is movably mounted on an inner wall d' of an instrument panel through spring pieces g, and a connector a' on a gauge board f' is fitted on the receiving connector h simultaneously when connecting the gauge board f' to the instrument panel.

However, when fitting the connector a', mounted on the gauge board f', on the receiving connector h, a fitting load acts directly on the receiving connector h, and therefore the instrument panel must be reinforced so as to withstand the fitting load. If this reinforcement is effected, there is encountered a problem that the instrument panel is increased in size and weight, and as a result, the weight of a vehicle body increases, and also the handling of the instrument panel is cumbersome.

SUMMARY OF THE INVENTION

This invention has been made in view of the above problems, and an object of the invention is to provide an automatic connector mutually-fitting mechanism in which an operation, in which a wire harness is drawn out, and connectors are manually fitted together, does not need to be effected, and a manual operation of a fitting lever does not need to be effected, and instead the connectors can be fitted together by an operation of mutually connecting structural members having the connectors beforehand mounted thereon, respectively.

In order to achieve the above object, the invention provides an automatic connector mutually-fitting mechanism comprising: two structural members to be connected together; two connectors to be fitted together, one of the connectors being projectably and retractably mounted on one of the structural members, a driven pin being formed on and projecting from a housing of the one connector, and the other of the connectors being fixedly secured to the other of the structural members; a fitting lever having a first cam groove and a second cam groove and movably mounted on one of the structural members; and a drive projection formed on the other of the structural members, wherein the drive projection is engaged in the first cam groove while the driven pin is engaged in the second cam groove, and the structural members are connected together, and are disengaged from each other, so that the connectors are fitted together, and are disengaged from each other through the movement of the fitting lever effected in accordance with the connecting and disengaging operations of the structural members.

BRIEF DESCRIPTION OF THE DRAWINGS

FIG. 2(*b*) is a plan view of the same;

FIG. 3(*b*) is a plan view of the same;

DETAILED DESCRIPTION OF THE PREFERRED EMBODIMENTS

A preferred embodiment of the present invention will now be described.

Figure 1:
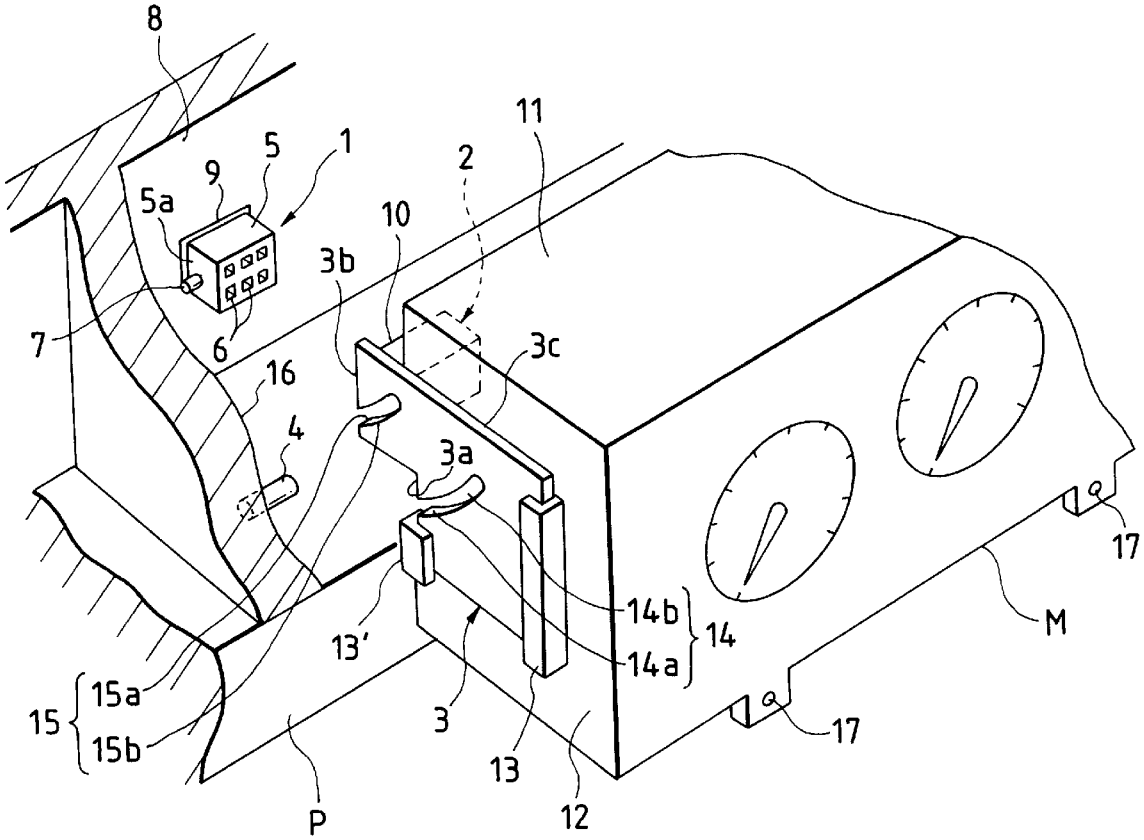
FIG. 1 is a perspective view showing a preferred embodiment of an automatic connector mutually-fitting mechanism of the present invention applied to an instrument panel and a gauge board.

FIG. 1 is a perspective view showing an automatic connector fitting mechanism of the invention applied to an instrument panel (structural member) P of an automobile and a gauge board (structural member) M to be connected to the instrument panel P.

The automatic connector fitting mechanism of this embodiment comprises a male connector 1 projectably and retractably mounted on the instrument panel P, a female connector 2 fixedly mounted on a rear surface of the gauge board M, a fitting lever 3 movably mounted on a side wall of the gauge board M, and a drive projection 4 mounted on the instrument panel P.

The male connector 1 includes a housing 5 which is molded of a synthetic resin, and has a box-shape of a square cross-section, and the housing 5 has a plurality of terminal receiving chambers 6 formed therein. Female metal terminals not shown) are mounted respectively in the terminal receiving chambers 6, and a driven pin 7 is formed on and projects from a side surface 5*a* of the housing 5.

The male connector 1 is projectably and retractably mounted in a receiving hole 9 formed in an inner wall 8 of a gauge-board receiving portion of the instrument panel P, the receiving hole 9 being open toward a direction of mounting of the gauge board M.

The female connector 2 is molded of a synthetic resin, and has a reception portion 10 of a square cross-section for receiving the housing 5 of the male connector 1, and a plurality of male metal terminals (not shown) project into the reception portion 10. The female connector 2 is fixedly mounted on a rear wall 11 of the gauge board M in opposed relation to the male connector 1.

The fitting lever 3 is in the form of a flat plate of an L-shape, and is movably mounted in opposed guides 13 and 13' mounted on a side wall 12 of the gauge board M.

Two cam grooves, that is, a first cam groove 14 and a second cam groove 15, are formed in the fitting lever 3.

The first cam groove 14 has a curved portion 14*b* extending from an inlet portion 14*a* (which is open to a lower side edge 3*a* of the L-shaped fitting lever 3) toward an upper edge 3*c* of the fitting lever 3, and the first cam groove 14 is adapted to receive the drive projection 4 formed on a side wall 16 of the instrument panel P for receiving the gauge board M.

The second cam groove 15 has a curved portion 15*b* extending from an inlet portion 15*a* (which is open to an upper side edge 3*b* of the L-shaped fitting lever 3) toward the upper edge 3*c* of the fitting lever 3, and the second cam groove 15 serves as a drive cam adapted to receive the driven pin 7 on the male connector 1 so as to drive the male connector 1.

A process of fitting the two connectors 1 and 2 together by connecting the gauge board M to the instrument panel P will now be described.

Figure 2A:
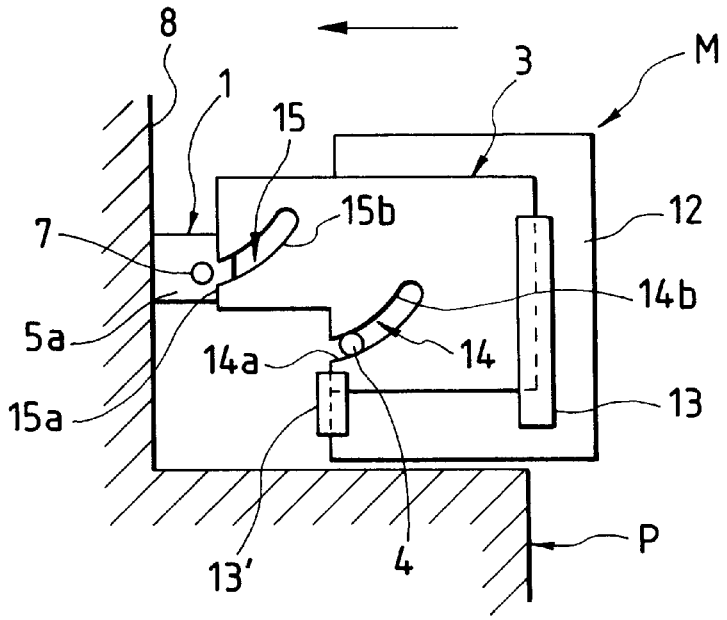
FIG. 2(*a*) is a side-elevational view of the gauge board having a fitting lever mounted thereon.
Figure 2B:
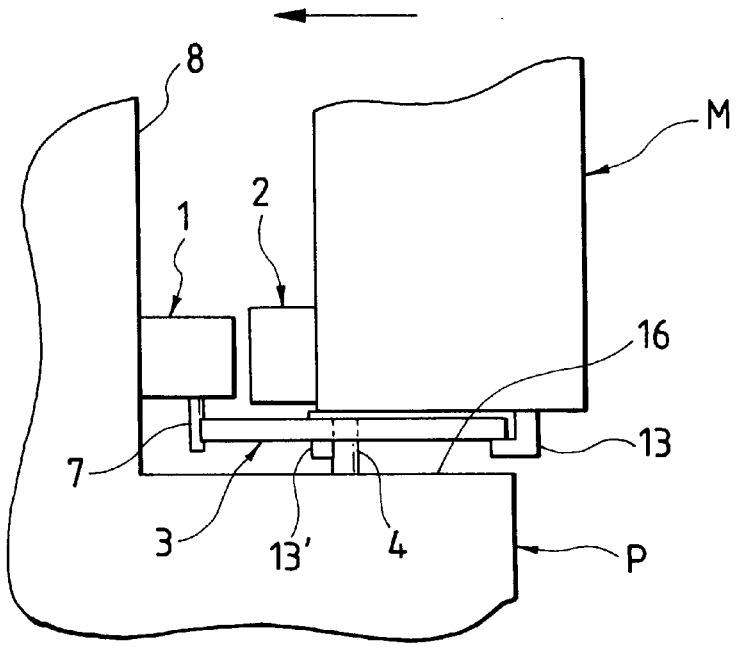

First, as shown in FIGS. 2(*a*) and 2(*b*), the inlet portion 14*a* of the first cam groove 14 of the fitting lever 3, mounted on the gauge board M, is brought into registry with the drive projection 4 of the instrument panel P. On the other hand, the inlet portion 15*a* of the second cam groove 15 is brought into registry with the driven pin 7 of the male connector 1.

Figure 3A:
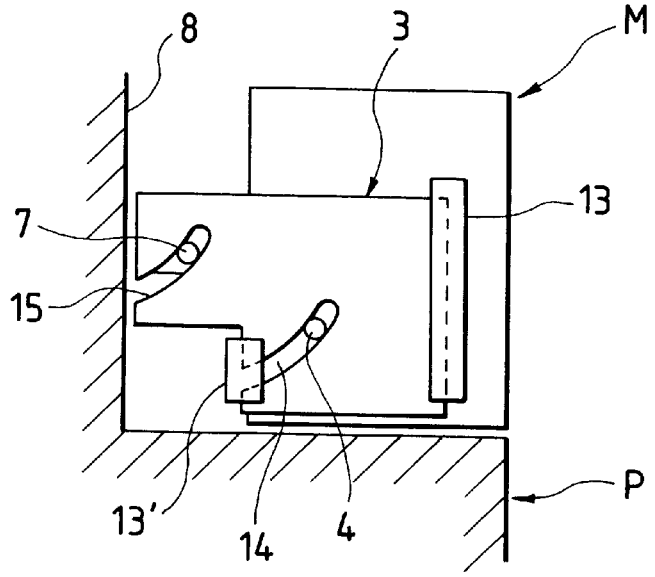
FIG. 3(*a*) is a side-elevational view of the gauge board having the fitting lever mounted thereon in a condition in which two connectors are fitted together.
Figure 3B:
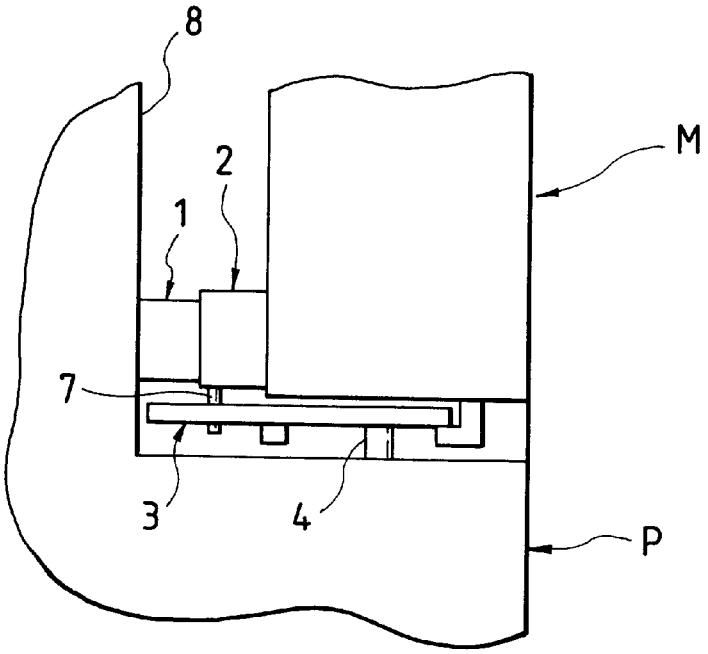

Then, when the gauge board M is pushed toward the inner wall 8 of the instrument panel P as indicated by an arrow, the first cam groove 14 slides relative to the drive projection 4, so that the fitting lever 3 moves downward as shown in FIGS. 3(*a*) and 3(*b*). In accordance with the downward movement of the fitting lever 3, the driven pin 7, engaged in the second cam groove 15, is moved, thereby drawing the male connector 1 forwardly, so that the male connector 1 is fitted into the female connector 2 fixedly mounted on the gauge board M, and as a result the metal terminals in the two connectors 1 and 2 are fitted together. After the two connectors 1 and 2 are fitted together, bolts (not shown) are passed respectively through mounting holes 17 in the gauge board M, fixedly securing the gauge board M to the instrument panel P.

For disengaging the fitted connectors 1 and 2 from each other, the gauge board M is drawn from the instrument panel P, so that the fitting lever 3 operates in a manner reverse to the above fitting process, and the fitting between the two connectors 1 and 2 is easily released.

Figure 4:
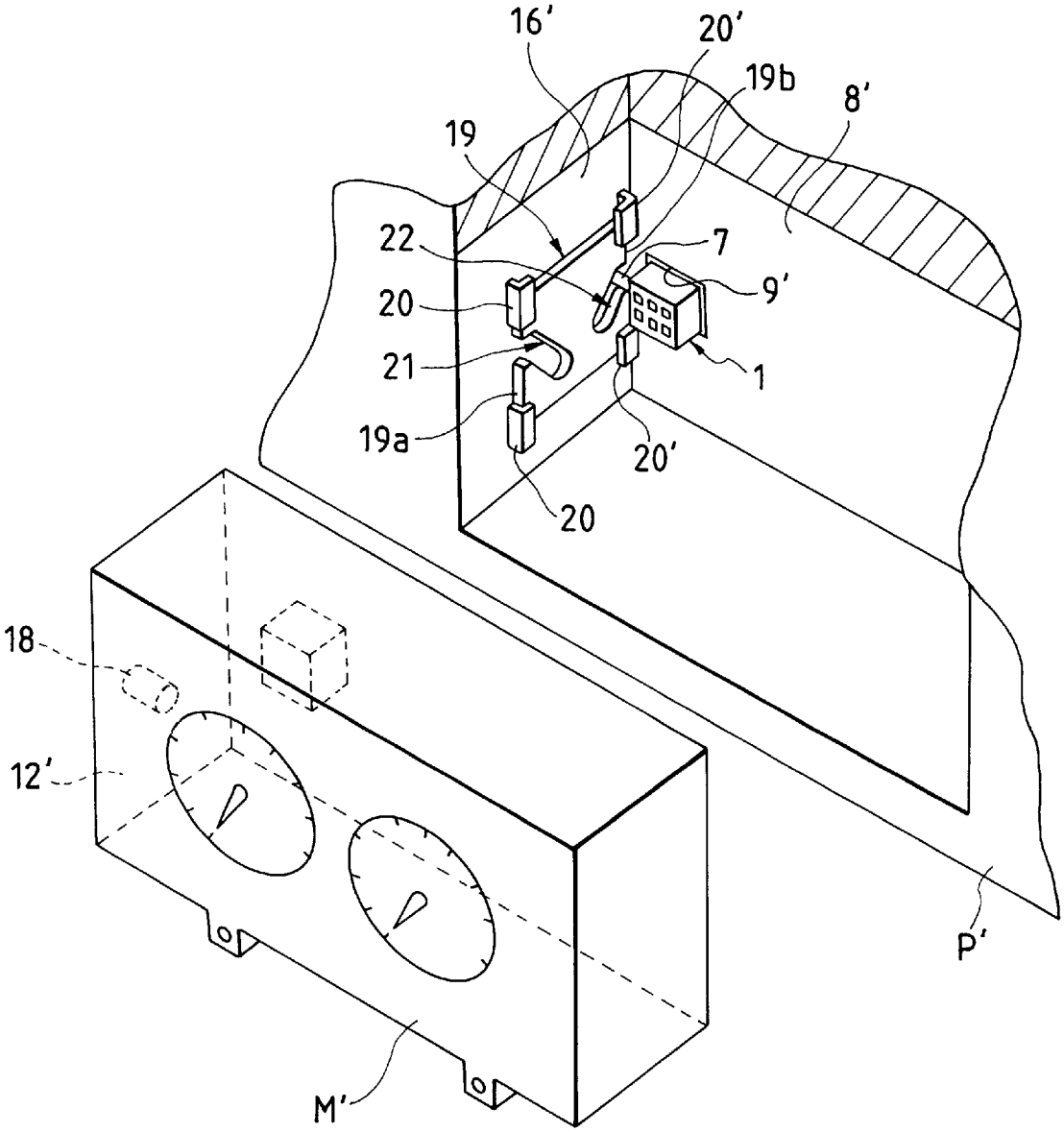
FIG. 4 is perspective view showing another embodiment of the automatic connector mutually-fitting mechanism of the invention applied to an instrument panel and a gauge board.

FIG. 4 is a perspective view showing another embodiment of the automatic connector fitting mechanism of the invention.

The automatic connector fitting mechanism, shown in FIG. 4, comprises a male connector 1 projectably and retractably mounted in a receiving hole 9', formed in an inner wall 8' of an instrument panel P' as in the preceding embodiment, a female connector 2 fixedly mounted on a gauge board M', a drive projection 18 mounted on a side wall 12' of the gauge board M', and a fitting lever 19 movably mounted on a side wall 16' of the instrument panel P'.

In the automatic connector fitting mechanism shown in FIG. 4, in contrast with the preceding embodiment of FIG. 1, the drive projection 18 is mounted on the gauge board M', and the fitting lever 19 is mounted on the instrument panel P'.

The instrument panel P', the male connector 1, the gauge board M' and the female connector 2 are similar to those of the preceding embodiment, respectively, and therefore explanation thereof will be omitted.

Figure 5:
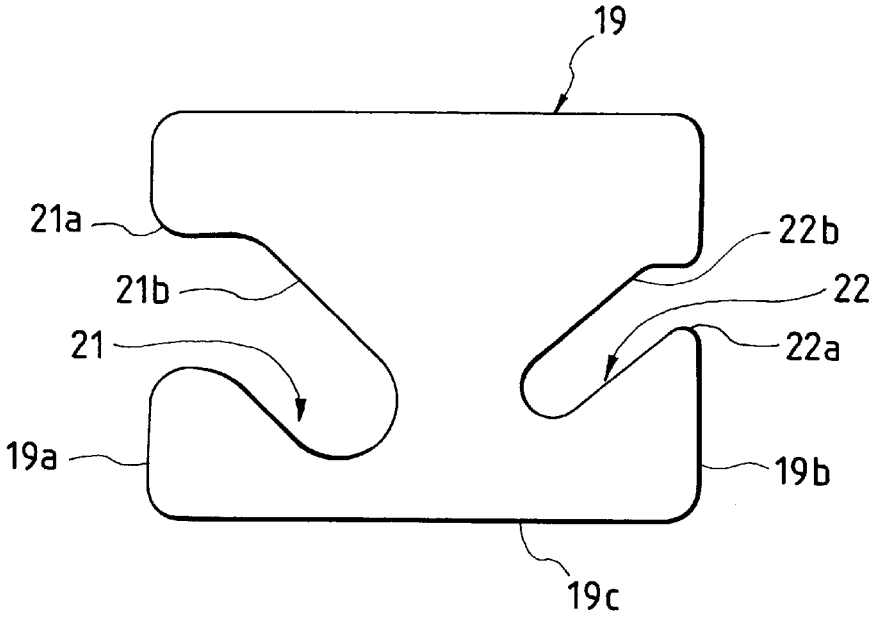
FIG. 5 is a front-elevational view of a fitting lever of FIG. 4.

The fitting lever 19 is in the form of a flat plate of a rectangular shape, and is received in guides 20 and 20' mounted on the side wall 16' of the instrument panel P', and is movable substantially perpendicularly (upward and downward) to a direction of mounting of the gauge board M'. As shown in FIG. 5, a first cam groove 21, having an inlet portion 21*a* at one end 19*a* of the fitting lever 19, and a second cam groove 22, having an inlet portion 22*a* at the other end 19*b* of the fitting lever 19, are formed in the fitting lever 19.

The first cam groove 21 has a slanting portion 21*b* extending from the inlet portion 21*a* toward a lower edge 19*c* of the fitting lever 19, and the first cam grooves 21 receives the drive projection 18 to drive the fitting lever 19.

The second cam groove 22 has a slanting portion 22*b* extending from the inlet portion 22*a* toward the lower edge 19*c* of the fitting lever 19, and in accordance with the movement of the fitting lever 19, the second cam groove 22 drives a driven pin 7 of the male connector 1 to draw the male connector 1 from the instrument panel P'.

A process of fitting the two connectors 1 and 2 together through the operation of the fitting lever 19 effected when mounting the gauge board M' on the instrument panel P will now be described.

First, before effecting the operation of mounting the gauge board M', the driven pin 7 of the male connector 1 is disposed at the inlet portion 22*a* of the second cam groove 22 of the fitting lever 19 movably mounted on the side wall 16' of the instrument panel P'.

Figure 6:
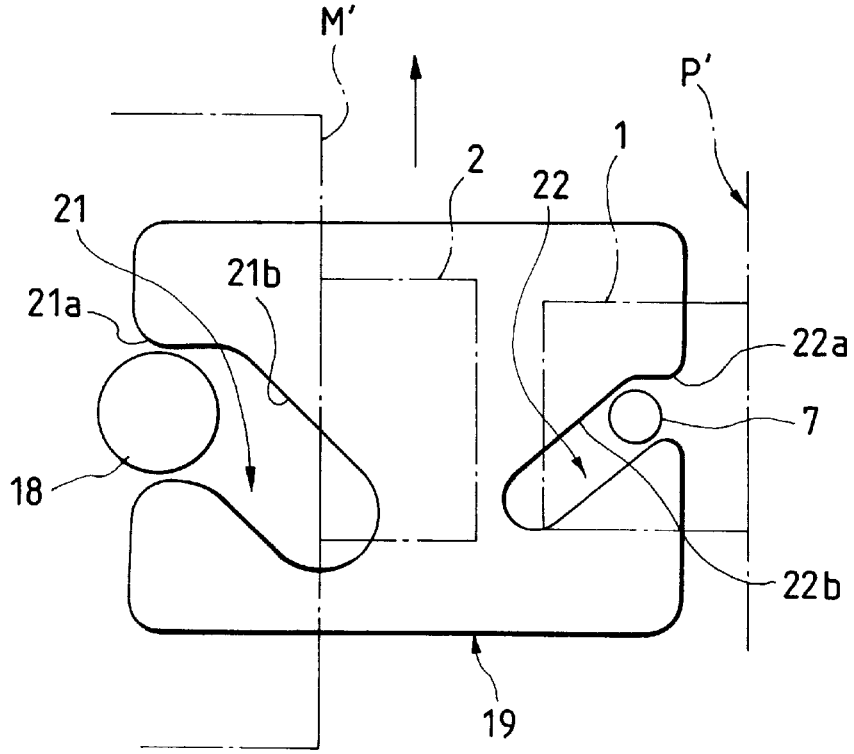
FIG. 6 is a view showing a process of fitting two connectors together by the fitting lever of FIG. 5.
Figure 7:
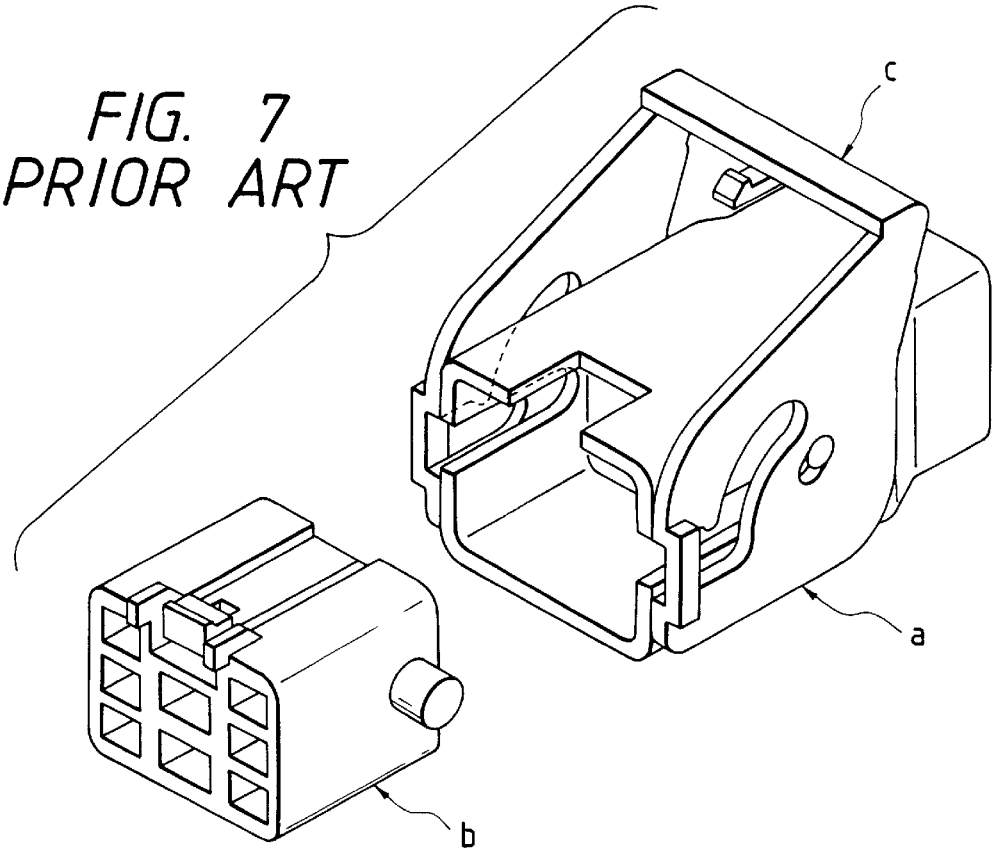
FIG. 7 PRIOR ART
FIG. 7 is a perspective view of a conventional lever connecting-type connector.
Figure 9:
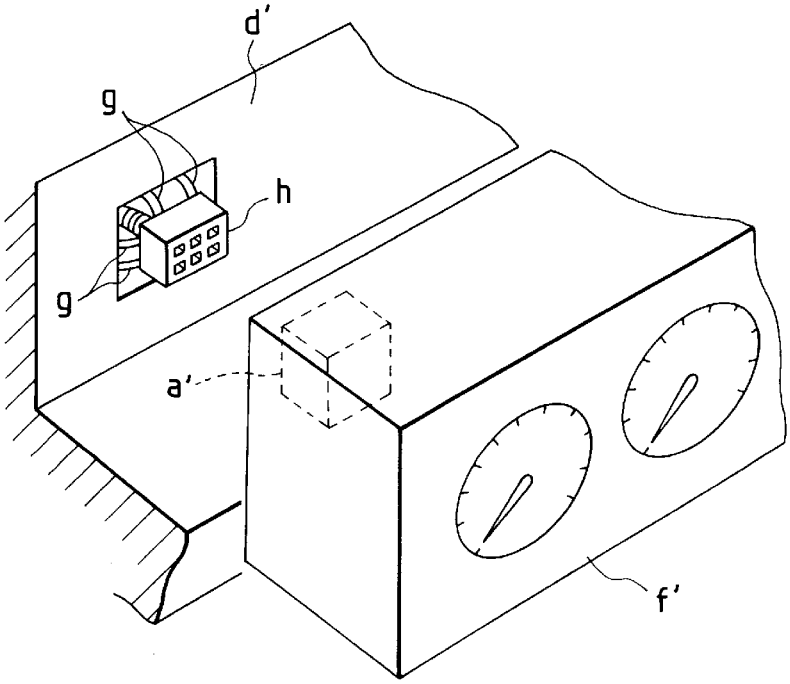
FIG. 9 PRIOR ART
FIG. 9 is a perspective view showing a conventional connecting mechanism using a receiving connector.
Figure 8:
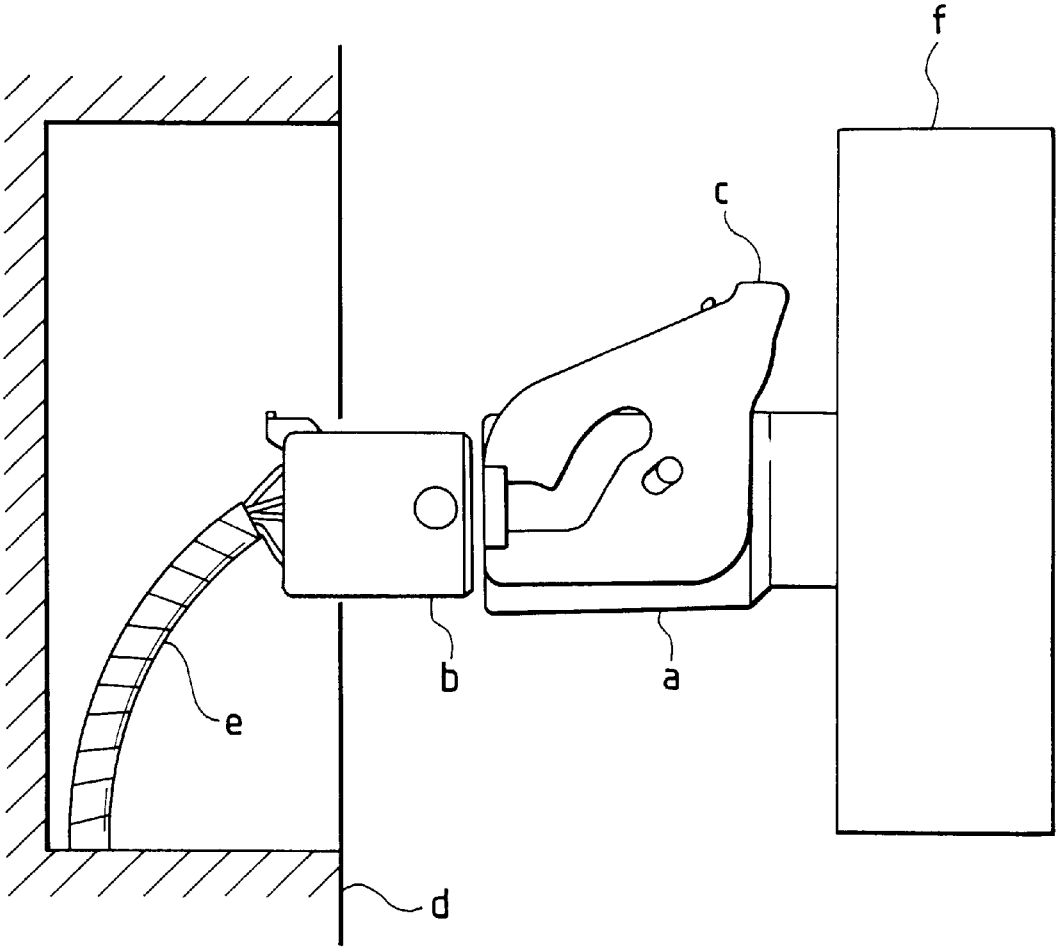
FIG. 8 PRIOR ART
FIG. 8 is a view showing the lever connecting-type connector of FIG. 7 applied to an instrument panel and a gauge board.

Then, as shown in FIG. 6, the drive projection 18, formed on the gauge board M', is disposed at the inlet portion 21*a* of the first cam groove 21 of the fitting lever 19 mounted on the instrument panel P', and the gauge board M' is pushed toward the male connector 1.

By thus pushing the gauge board M', the drive projection 18 is moved along the slanting portion 21*b* of the first cam groove 21, thereby moving the fitting lever 19 upward in a direction of an arrow.

In accordance with the upward movement of the fitting lever 19, the driven pin 7, engaged in the second cam groove 22, is moved, thereby drawing the male connector 1 toward the female connector 2, so that the female connector 2, fixedly secured to the gauge board M', and the male connector 1 are fitted together.

For disengaging the fitted connectors 1 and 2 from each other, the gauge board M' is drawn from the instrument panel P' as in the preceding embodiment, so that the fitting lever 19 operates in a manner reverse to the above fitting process, and the fitting between the two connectors 1 and 2 is easily released.

In the present invention, the fitting lever does not need to be manually operated, and the two connectors can be fitted together by the operation of connecting the two structural members together. Therefore, the operation, in which the wire harness is drawn out, and the two connectors are fitted together, and the operation of the lever, are omitted, and the production efficiency of the connecting operation is greatly enhanced, and besides an excess length of the wire harness is unnecessary, thus saving the member, and further an accident such as the biting of the wire harness during the connecting operation is prevented. Thus, many advantages are achieved.

What is claimed is:

1. An automatic connector mutually-fitting mechanism comprising:

two structural members to be connected together;

two connectors to be fitted together, one of said connectors being projectably and retractably mounted on one of said structural members, a driven pin being formed on and projecting from a housing of said one connector, and the other of said connectors being fixedly secured to the other of said structural members;

a fitting lever having a first cam groove and a second cam groove and movably mounted on one of said structural members; and a drive projection formed on the other of said structural members, wherein said drive projection is engaged in said first cam groove while said driven pin is engaged in said second cam groove, and said structural members are connected together, and are disengaged from each other, so that said connectors are fitted together, and are disengaged from each other through the movement of said fitting lever effected in accordance with the connecting and disengaging operations of said structural members.

2. The automatic connector mutually-fitting mechanism according to claim 1, wherein said one structural member is an instrument panel of an automobile, and said other structural member is a device to be connected to said instrument panel, and wherein said drive projection is formed on a wall of said instrument panel, and said fitting lever is movably mounted on said device.

3. The automatic connector mutually-fitting mechanism according to claim 1, wherein said one structural member is an instrument panel of an automobile, and said other structural member is a device to be connected to said instrument panel, and wherein said fitting lever is movably mounted on a wall of said instrument panel, and said drive projection is formed on said device.

* * * * *